US007496327B2

(12) United States Patent
Nagamoto et al.

(10) Patent No.: US 7,496,327 B2
(45) Date of Patent: Feb. 24, 2009

(54) MUSIC INFORMATION, UPDATING SYSTEM, MUSIC INFORMATION BROADCASTING APPARATUS, TERMINAL APPARATUS HAVING MUSIC INFORMATION UPDATING FUNCTION, MUSIC INFORMATION UPDATING METHOD, MUSIC INFORMATION BROADCASTING METHOD, AND MUSIC INFORMATION UPDATING METHOD OF TERMINAL APPARATUS

(75) Inventors: Satoru Nagamoto, Kobe (JP); Takao Yamaguchi, Kobe (JP)

(73) Assignee: Fujitsu Ten Limited, Jobe-shi (JP)

( * ) Notice: Subject to any disclaimer, the term of this patent is extended or adjusted under 35 U.S.C. 154(b) by 0 days.

(21) Appl. No.: 10/554,639

(22) PCT Filed: Aug. 25, 2004

(86) PCT No.: PCT/JP2004/012610
§ 371 (c)(1),
(2), (4) Date: Oct. 25, 2005

(87) PCT Pub. No.: WO2005/020484

PCT Pub. Date: Mar. 3, 2005

(65) Prior Publication Data

US 2006/0286951 A1 Dec. 21, 2006

(30) Foreign Application Priority Data

Aug. 25, 2003 (JP) ..... 2003-299929

(51) Int. Cl.
*H04H 20/71* (2008.01)
*H04H 20/74* (2008.01)

(52) U.S. Cl. ..... 455/3.01; 455/3.02

(58) Field of Classification Search ..... 455/3.01, 455/3.02
See application file for complete search history.

(56) References Cited

U.S. PATENT DOCUMENTS 4,788,675 A * 11/1988 Jones et al. ..... 370/487
5,561,849 A * 10/1996 Mankovitz ..... 455/45
6,317,784 B1 * 11/2001 Mackintosh et al. ..... 709/219
6,754,226 B1 * 6/2004 Nakano ..... 370/466
6,925,489 B1 * 8/2005 Curtin ..... 709/217
6,990,498 B2 * 1/2006 Fenton et al. ..... 707/102

(Continued)

FOREIGN PATENT DOCUMENTS

EP 1137210 A2 * 9/2001

(Continued)

*Primary Examiner*—Matthew D Anderson
*Assistant Examiner*—Bobbak Safaipour
(74) *Attorney, Agent, or Firm*—Fogg & Powers LLC

(57) ABSTRACT

An updating system able to easily and cheaply update music information in a terminal having a memory function unit storing music information of track data and music database information.

A broadcasting apparatus 20 is configured by a broadcasting side memory function unit 21 for storing music information including track data and music database information and a transmission function unit 23 for broadcasting the music information on a broadcast channel, and a terminal 30 is configured by a reception function unit 31 for receiving the broadcast wave thereof, an extraction function unit 32 for extracting the music information from the received broadcast wave, and an update function unit 33 for updating the information in the reception side memory function unit 34 with the extracted music information.

13 Claims, 8 Drawing Sheets

U.S. PATENT DOCUMENTS

| | | | | |
|---|---|---|---|---|
| 7,162,471 | B1 * | 1/2007 | Knight et al. | 707/3 |
| 2003/0026344 | A1 * | 2/2003 | Rindsberg et al. | 375/260 |
| 2003/0125033 | A1 * | 7/2003 | Rindsberg et al. | 455/450 |
| 2005/0038819 | A1 * | 2/2005 | Hicken et al. | 707/104.1 |
| 2006/0229904 | A1 * | 10/2006 | Hunter et al. | 705/1 |

FOREIGN PATENT DOCUMENTS

| | | |
|---|---|---|
| JP | A 10-105184 | 4/1998 |
| JP | 11030524 | 2/1999 |
| JP | A 11-098217 | 4/1999 |
| JP | 2001298430 | 10/2001 |
| JP | A 2001-343979 | 12/2001 |
| JP | A 2003-022082 | 1/2003 |
| JP | A 2003-058723 | 2/2003 |

* cited by examiner

MUSIC INFORMATION, UPDATING SYSTEM, MUSIC INFORMATION BROADCASTING APPARATUS, TERMINAL APPARATUS HAVING MUSIC INFORMATION UPDATING FUNCTION, MUSIC INFORMATION UPDATING METHOD, MUSIC INFORMATION BROADCASTING METHOD, AND MUSIC INFORMATION UPDATING METHOD OF TERMINAL APPARATUS

CROSS REFERENCE TO RELATED APPLICATIONS

This application claims priority to International Patent Application No. PCT/JP2004/012610 filed on Aug. 25, 2004, which claims priority to Japanese Patent Application No. 2003-299929 filed on Aug. 25, 2003.

TECHNICAL FIELD

The present invention relates to an updating system of music information, a broadcasting apparatus of music information, a terminal having an updating function of music information, an updating method of music information, a broadcasting method of music information, and a method for updating music information in terminal.

BACKGROUND ART

Development of terminal, particularly terminal to be mounted in automobiles, has been remarkable. The equipment is becoming increasingly higher in performance along with the increasing sophistication of network communications. For example, high performance automobile mounted terminal equipped with audio and visual functions such as navigation and CD, MD, DVD, MP3, and other music files, broadcast reception functions such as TV, FM•AM/FM multiplex/FM-VICS, and sound field and tone adjustment functions such as DSP and equalizers are already commercially available.

The present invention is aimed at for example the terminal as described above and among them especially notes the "audio and visual functions" among the above various types of optional functions.

The "audio and visual functions" are realized linked with a memory built into the terminal such as a HDD (hard disk drive). "Music information" can be recorded or previously recorded in this memory. Here, "music information" means information of a music database.

FIG. 8 is a diagram for explaining the information covered by the present invention.

In the figure, only a recording medium (for example a CD) 1, a display unit 2, and a memory (for example HDD) 3 in a terminal 30 are taken out and diagrammatically drawn.

This memory 3, for example, stores track data and information of an approximately 230,000 track music database. This music database includes identifying information of the recording media (for example TOC) and music menu information corresponding to the identifying information such as title names, album names, track names, artist names, and genres. Accordingly, the equipment 30 easy realizes a so-called auto titling function using this music database information.

Namely, in the equipment 30, the music database information is automatically recorded when recording music on a music recording medium (for example CD) in the memory 3. For this reason, the convenience of enabling the content of the music library to be prepared in the memory 3 without requiring troublesome title input can be provided to the user of the equipment 30.

[1], [2], and [3] in the figure represent an example of the process of the above auto titling function in three steps.

In [1], when the recording medium 1 from which the user desires to record is inserted into slot (not illustrated) of the equipment 30, in [2], on the basis of the identifying information stored in the recording medium 1, for example, the TOC (Table Of Contents) information, the music menu information is searched for from the above music database in the memory 3. Note that this TOC information usually includes the total performance time, the number of recorded tracks, and their recorded positions.

In [3], when the search turns up music menu information matching the identifying information, the title name can be extracted and that title name added to the track data recorded from the recording media 1 in the above [1]. This completes the auto titling process.

In this way, the terminal 30 can also provide the service of freedom from troublesome title input. However, there are also inconvenient points. These are the point that when the track data and music database information are previously recorded, after the terminal 30 is mounted in a vehicle, upgrading, that is, updating, of the built-in memory 3 in the terminal 30 is not possible, and the point that when track data can be additionally recorded, additional recording is troublesome. That is, when the track data and the music data are previously recorded, the memory 3 cannot be input with titles and input with track data of recording media of new music put on sale thereafter. Alternatively, it cannot be input with titles and input with track data of recording media of revivals which become popular thereafter. Also, when track data can be additionally recorded, the user must go to a store selling the recording medium or a rental shop, purchase or rent there the medium, and then perform recording work.

Accordingly, a user of this terminal would find it extremely convenient if subsequent addition to or other updating of music information could be simply and easily, at low cost, carried out.

A conventional technique which can deal with this will be explained below.

FIG. 9 is a diagram showing a conventional technique for updating music information (first example).

According to the updating technique according to this conventional first example,

[1] the user of the terminal 30 accesses a recording medium music information update site 5 on the Internet from his personal computer 6.

[2] On the site 5, the user extracts parts of the title database and track database which he has not yet acquired, that is, the difference from his already acquired title database and track database, and downloads the extracted difference in title database and difference in track database to his personal computer 6.

[3] The user transfers the difference in title database and the difference in track database downloaded into the personal computer 6 to a carrying medium 7. The user brings the carrying medium 7 to the terminal 30 and installs the difference in title database and difference in track database into the memory 3. This carrying medium 7 is for example a Memory Stick®.

Here, the titles of new recording media such as new music and the titles of the tracks recorded on the recording media and the tracks themselves are recorded in the memory 3 for updating.

According to the updating technique according to a conventional second example, the user directly connects to a center managing the music/track database by a communication function unit and acquires the difference in title database and difference in track database. This communication function unit is for example a portable telephone directly connected to the terminal 30.

Note that, as known art relating to the present invention, there are the following Patent Documents 1 and 2. However, as will be apparent from the explanation given later, both known arts are different from the music information updating system of the present invention comprising a "broadcasting apparatus having a broadcasting side memory function unit for storing music information including at least one of track data and music database information and a transmission function unit for broadcasting the music information on a predetermined broadcast channel and terminal having a reception function unit for receiving a broadcast wave of the above-described predetermined broadcast channel, an extraction function unit for extracting the above-described music information from the received broadcast wave, and an update function unit for updating the music information in the reception side memory function unit with the extracted music information".

Note that the system according to Patent Document 1 uses a tuner receiving an FM multiplex broadcast to demodulate the information concerning the music distribution from an FM signal and transmit the data to the HDD recorder equipped with a communication function. This HDD recorder equipped with a communication function activates software connected to the network on the basis of the data and connects to the URL of a download server distributing the music data included in the data. Due to this, the system receives the download of the music data.

Also, the apparatus of Patent Document 2 is an automobile mounted information terminal for receiving broadcasts of text information transmitted from an information center such as event information concerning events held at amusement facilities and specific areas and information changing day by day such as weather forecasts.

[Patent Document 1] Japanese Unexamined Patent Publication No. 2001-298430

[Patent Document 2] Japanese Unexamined Patent Publication No. 11-30524

DISCLOSURE OF THE INVENTION

Problem to be Solved by the Invention

According to the updating technique according to the conventional first example (FIG. 9), there is the problem that the demand from the user of "simply and easily" mentioned before cannot be satisfied.

Also, according to the updating technique according to the conventional second example (direct communication), there is the problem that the demand from the user of "easily and cheaply" mentioned before cannot be satisfied.

This is because, according to the updating technique according to the conventional first example,

- a personal computer 6 and Internet environment and a Memory Stick® or other carrying medium 7 are necessary,
- the user must download the data from the recording medium music information update site 5 by himself, and
- also, the trouble of upgrading the terminal 30 by using the carrying medium 7 becomes necessary.

Also, according to the updating technique according to the conventional second example,

- the trouble of using a portable telephone from the vehicle mounting the terminal 30 to connect the terminal 30 to a center managing the music/track database is necessary, and
- a communication fee for downloading the data from the center becomes necessary.

Accordingly, in consideration of the above problems, an object of the present invention is to provide a music information updating system enabling updating simply and easily and in addition cheaply when it is necessary to update the memory storing the music information in a terminal storing the music information due to for example the release of recording media of new music (for example CDs).

Means for Solving the Problems

FIG. 1 is a view of the basic configuration of an updating system of music information according to the present invention.

In the figure, reference numeral 10 is an updating system of music information roughly comprising a broadcasting apparatus 20 and a terminal 30 (FIG. 8 and FIG. 9).

The broadcasting apparatus 20 is configured by a broadcasting side memory function unit 21 for storing music information including at least one of track data and music database information and a transmission function unit 23 for broadcasting the music information on a predetermined broadcast channel.

On the other hand, the terminal 30 is configured by a reception function unit 31 for receiving the broadcast wave of a predetermined broadcast channel, an extraction function unit 32 for extracting the music information from the received broadcast wave, and an update function unit 33 for updating the music information in a reception side memory function unit 34 with the extracted music information.

In this way, the updating system 10 of the present invention distributes the music information and further updates the reception side memory function unit 34 by utilizing the general infrastructure constituted by a broadcast wave.

For this reason, the side providing the music information (broadcasting apparatus 20 side) needs the function of transmitting the track data and the database information on the broadcast wave.

Also, the user side (terminal 30 side) needs a function of receiving the broadcast wave of a predetermined broadcast channel, a function of extracting the music information from the received broadcast wave, and a function of recording the extracted music information in the reception side memory function unit 34.

By providing the above functions, the following characteristic features are obtained at the user side (terminal 30 side), the side providing the music information (broadcasting apparatus 20 side), and the user himself.

First, on the user side (terminal 30 side),

- so long as a general broadcast wave can be received, no special hardware is necessary.
- acquisition and addition of track data and music database information in units of albums are possible, therefore it is not necessary to continuously receive the broadcast wave for a long time.

Next, on the side providing the music information (broadcasting apparatus 20 side),

- no dedicated infrastructure equipment is necessary, so a new capital investment is unnecessary.

By extraction from the tracks or music database information under any conditions, distribution of database information specific to each broadcast office becomes possible. Further, distribution is possible even for recording media not yet put on sale so long as there is database information.

By setting the database information to album units, the load of the broadcast office may be reduced.

Further, when viewing the user himself, it becomes possible to simply, easily, and cheaply add track data and music database information. Note that, in the case of the track data, free distribution is difficult due to copyrights, but in the case of the music database, it is possible to make distribution free.

The track data and database information can be acquired by just receiving the broadcast wave, so no special operation etc. are necessary.

The transmission medium is the general infrastructure constituted by a broadcast wave, therefore no communication cost is required for acquiring the tracks and database information and also a database recording medium such as the Memory Stick mentioned above becomes unnecessary. Also, for the track data, only the actual costs need be paid.

Thus, all users owning the terminals 30 shown in FIG. 1 become able to update their reception side memory function units 34 simply and easily and in addition cheaply.

Effects of the Invention (1) As mentioned above, in the present invention, since the general infrastructure constituted by a broadcast wave can be utilized, the user can acquire music information without the burden of communication costs etc., recording media for installation in the product is not necessary, in the case of the conventional updating by download etc. using a personal computer, work such as connecting to the Internet, downloading the data files, moving the recording medium, and installation into the terminal are necessary, but according to the present invention, only a broadcast wave is received, therefore complex operation and knowledge are unnecessary, absolutely no new equipment or investment for realizing the service of the present invention is necessary, the already completed infrastructure network is utilized, therefore spread of the service on a national scale becomes possible, so long as the terminal side can receive general radio/TV/digital broadcasts, no new hardware is necessary.

(2) Also, in the present invention, by setting the music information for distribution to units of single titles, the load applied on the broadcast can be reduced, and it is not necessary to continuously receive the broadcast for a long time.

BEST MODE FOR CARRYING OUT THE INVENTION

Figure 1:
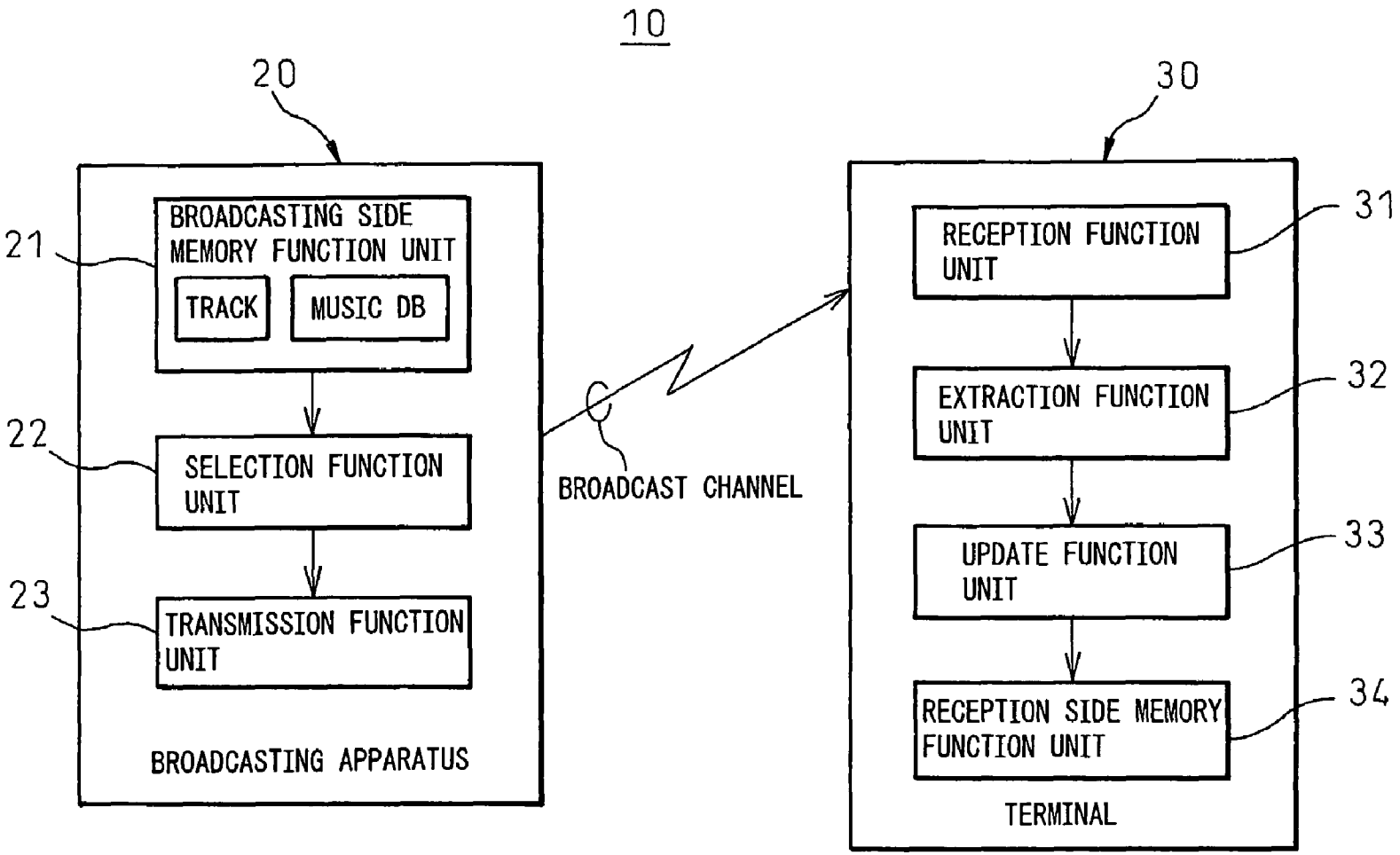
FIG. 1 is a view of the basic configuration of an updating system of music information according to the present invention.
Figure 2:
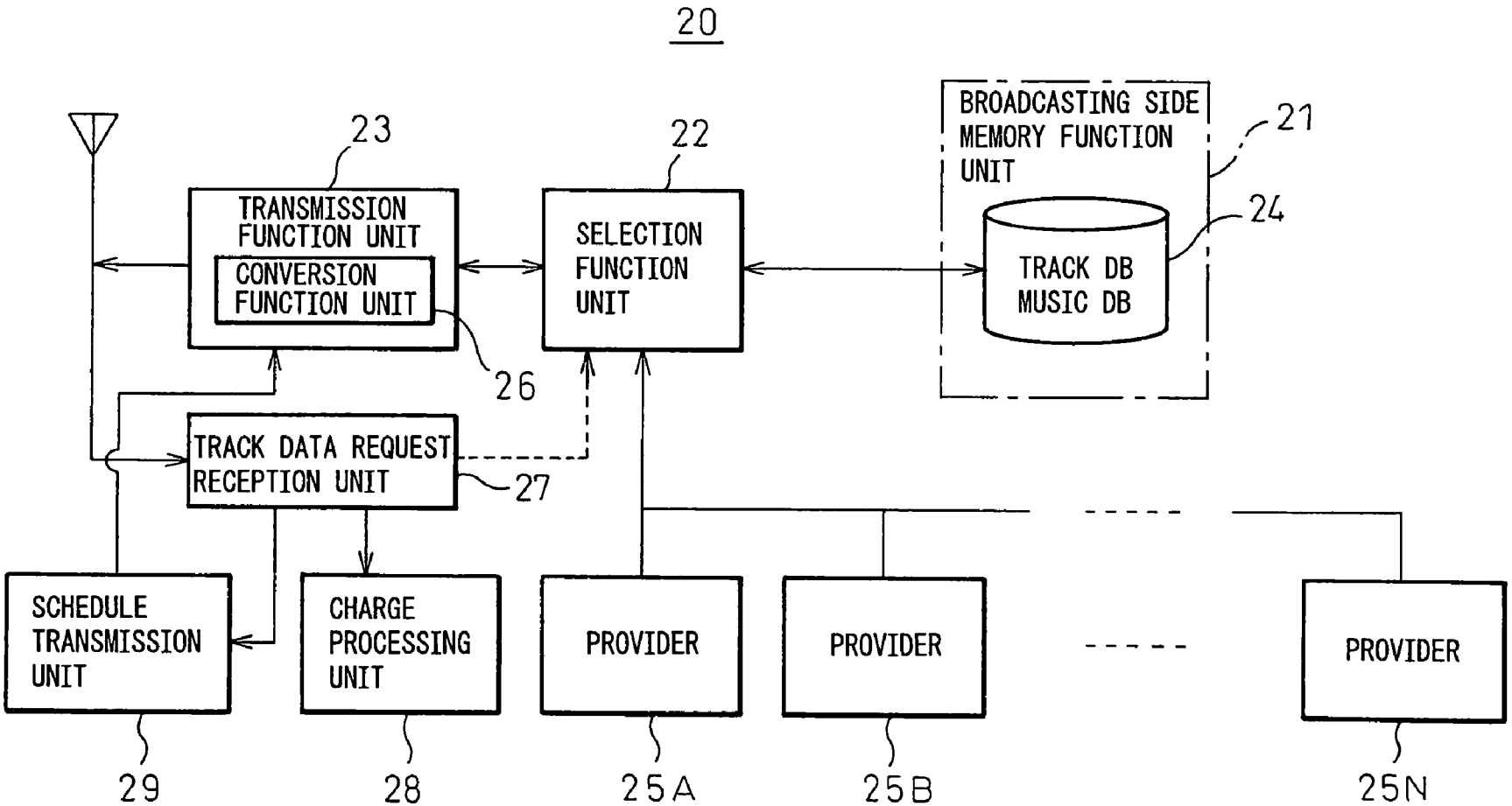
FIG. 2 is a diagram more specifically showing a broadcasting apparatus 20 shown in FIG. 1.

FIG. 2 is a diagram more specifically showing the broadcasting apparatus 20 shown in FIG. 1.

In the figure, the illustrated broadcasting apparatus 20 is a broadcasting apparatus constituting the transmission side in the updating system 10 of the music information and comprises a broadcasting side memory function unit 21 and a transmission function unit 23 as principal function units.

The broadcasting side memory function unit 21 stores music information including at least one of the track data and music database information, and the transmission function unit 23 transmits the music information on a broadcast channel so that download is possible on the reception side (30) of the updating system 10.

The broadcasting side memory function unit 21 has a built-in database source 24 which holds at least the track database (DB) and the music database (DB). This music database is comprised of identifying information (TOC) for identifying the recording media and music menu information corresponding to the identifying information. Further, this music menu information includes information such as title names, album names, artist names, and genres.

In this way, the music information held in the broadcasting side memory function unit 21 is transmitted to the reception side (30) on a predetermined broadcast channel by the transmission function unit 23.

Here, the broadcast channel is:

(i) a previously set specific channel in radio broadcasts;

(ii) a previously set specific channel in TV broadcasts; or (iii) a specific channel for carrying previously set additional information in digital broadcasts.

The music information to be conveyed on the broadcast channel is extremely desirably music information which is commonly desired to be updated for users owning the terminals 30. Therefore, as shown in FIG. 2, a selection function unit 22 for extracting the music information to be transmitted from the transmission function unit 23 from the broadcasting side memory function unit 21 is further provided. Note that it is also possible if the database source 24 is provided separately from the broadcasting side memory function unit 21, and the music information to be transmitted is extracted from the database source 24 by the selection function unit 22, stored in the broadcasting side memory function unit 21, and sent to the transmission function unit 23.

This selection function unit 22 selects the music to be updated, that is, transmitted, on the basis of various information from various music providers 25A, 25B, . . . , 25N and the terminals. Specifically, the following five modes of selection can be considered.

(i) The selection by the selection function unit is carried out on the basis of the number of times of broadcasting at each music provider 25.

(ii) The selection by the selection function unit is carried out on the basis of power play information generated between music providers linked with this.

(iii) The selection by the selection function unit is carried out on the basis of various popularity rankings from the music providers.

(iv) The selection by the selection function unit is carried out on the basis of the information on the relesae of new music from the music providers.

(v) The selection by the selection function unit is carried out on the basis of request rankings from terminals.

The "number of times of broadcasting" of (i) described above may include not only broadcasts by radio and TV, but also broadcasts by cable broadcasting systems.

The "power play information" of the above (ii) is information determined according to business discussions between providers.

The "popularity ranking" of the above (iii) includes the ranking at karaoke bars and the ranking on the basis of reports on the state of sales of CDs.

The "information on release of new music" of the above (iv) is from the recording companies.

The thus selected music information is therefore sent out to the reception side from the transmission function unit 23. The transmission function unit 23 transmits the music information constantly repeatedly or periodically at predetermined days (Saturdays, Sundays, public holidays, etc.). For this transmission, a predetermined format is used.

For this reason, as shown in FIG. 2, the transmission function unit 23 is further provided with a conversion function unit 26 for converting music information to the above-described format in order to send the music information over the broadcast channel. Note that the music information to be transmitted by the selection function unit 22 to the transmission function unit 23 is either all music information of the broadcasting side memory function unit 21 or the difference in music information newly added to the broadcasting side memory function unit 21.

Figure 3:
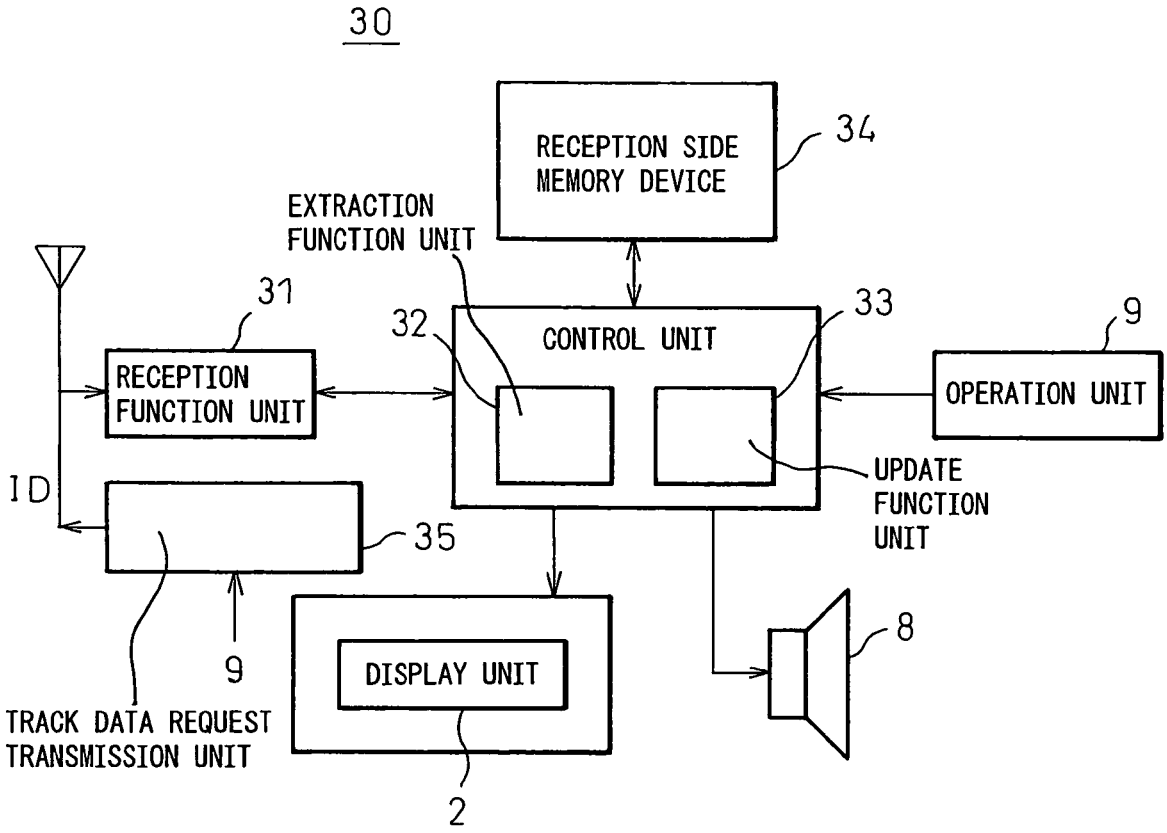
FIG. 3 is a diagram more specifically showing a terminal 30 shown in FIG. 1.

FIG. 3 is a diagram more specifically showing the terminal 30 shown in FIG. 1.

In the figure, the illustrated terminal 30 is a terminal forming the reception side in the updating system 10 of the music information and comprising the illustrated four function units 31 to 34.

The reception side memory function unit 34 stores music information including at least one of the track data and the music database information, the reception function unit 31 receives the music information transmitted on a predetermined channel of the broadcast wave, the extraction function unit 32 extracts the music information from the predetermined channel of the received broadcast wave, and the update function unit 33 updates the information in the reception side memory function unit 34 with the extracted music information.

As previously explained, the music information is sent from the broadcasting apparatus 20 side in the predetermined format. Therefore, the extraction function unit 32 extracts the music information inserted in a predetermined channel of the broadcast wave in the predetermined format according to the format.

The music information extracted from the extraction function unit 32 is updated at the reception side memory function unit 34 by the update function unit 33, the track data is output from an audio output unit 8, and the music menu is displayed on a display unit 2. This mode of updating includes the following three patterns.

(i) When receiving all music information from the broadcasting side memory function unit 21 on the broadcasting apparatus 20 side in the updating system 10, the update function unit 33 rewrites the reception side memory function unit 34 with all that music information. Note that this pattern cannot be applied to a case where the broadcasting side memory function unit 21 stores the difference in music information.

(ii) When receiving all music information from the broadcasting side memory function unit 21 on the broadcasting apparatus 20 side in the updating system 10, the update function unit 33 finds the unrecorded music information from among them and stores this in the reception side memory function unit 34 as the newly added difference in music information.

(iii) When receiving the newly added difference in music information from the broadcasting side memory function unit 21 on the broadcasting apparatus 20 side in the updating system 10, the update function unit 33 adds and stores the difference in music information in the reception side memory function unit 34.

In this case, as previously mentioned, the music information or the difference in music information is broadcasted from the broadcasting apparatus 20 side constantly repeatedly or periodically on predetermined days, therefore the update function unit 33 once holds the information. Then, when detecting that the information is not the same as the already received information, the information is stored in the reception side memory function unit 34.

Note that reception of a predetermined channel of this broadcast wave may also be limited to users permitted to receive the music information service. In this case, the reception function unit 31 receives a broadcast wave carrying the music information of the broadcast channel locked on the broadcasting apparatus 20 side, decodes the music information after unlocking the broadcast channel with a key held by the terminal 30, and then outputs the same to the extraction function unit 32. That is, a user who does not hold this key cannot receive the present service. This key may be previously set in the terminal 30 or the key may be purchased and set in the terminal 30.

Above, the present invention was explained from the viewpoint of the hardware configuration by referring to FIG. 1 to FIG. 3, but the present invention can also be understood as a novel method. An explanation will be given of this method below.

[A] The method according to the present invention is an updating method of music information in an updating system 10 of music information provided with a broadcasting apparatus 20 and a terminal 30, comprising, at the broadcasting apparatus 20, Step S11: storing music information including at least one of track data and music database information.

Step S12: broadcasting the music information on a predetermined broadcast channel.

and, at the terminal 30 provided with the reception side memory function unit 34 for storing the music information, Step S21: receiving the broadcast wave of the predetermined broadcast channel.

Step S22: extracts the above music information from the broadcast wave of the received predetermined broadcast channel.

Step S23: updates he information in the reception side memory function unit 34 by the extracted music information.

(a) The Step S12 for broadcasting preferably has a step of selecting the music information to be broadcasted. This selection step is a selection step for extracting the music information to be broadcasted from the broadcasting side memory function unit or a selection step for selecting and collecting the music information to be stored in the broadcasting side memory function unit.

(b) The selection step can be carried out on the basis of the number of times of broadcasts at each music provider.

The selection step can also be carried out on the basis of the power play information generated between the music providers linked with this.

The selection step can also be carried out on the basis of various popularity rankings of the music providers.

The selection step can also be carried out on the basis of information of release of new music from the music providers.

The selection step can also perform the selection of the music information on the basis of the track data request from the terminal either.

(c) The aforementioned broadcasting step S12 broadcasts the music information constantly repeatedly or periodically on predetermined days.

The aforementioned broadcasting step S12 converts the music information to a format for broadcasting the music information on a predetermined broadcast channel.

(d) The selection step of (a) described above selects either all music information of the broadcasting side memory function unit 21 or the difference in music information newly added to the broadcasting side memory function unit 21.

[B] The method according to the present invention is an updating method of music information in an updating system 10 of music information provided with a broadcasting apparatus 20 and a terminal 30, compring, in the terminal 30 provided with a reception side memory function unit 34 for storing the music information, Step S31: receiving the music information broadcasted on a predetermined broadcast channel from the broadcasting apparatus 20 side.

Step S32: extracting the music information from the broadcast wave of the predetermined broadcast channel.

Step S33: updating the information in the reception side memory function unit 34 by the extracted music information.

(a) In the aforementioned extraction step S32, the music information broadcasted on the predetermined broadcast channel in the predetermined format is extracted according to the format.

(b) In the aforementioned updating step S33, when receiving all music information from the broadcasting side memory function unit 21 on the broadcasting apparatus 20 side, the reception side memory function unit 34 is rewritten with that music information.

In the aforementioned updating step S33, further, when receiving all music information from the broadcasting side memory function unit 21 on the broadcasting apparatus 20 side, the unrecorded music information may be calculated from among them and stored in the reception side memory function unit 34 as the newly added difference in music information.

In the aforementioned updating step S33, furthermore, when receiving the newly added difference in music information from the broadcasting side memory function unit 21 on the broadcasting apparatus 20 side, the difference in music information may be added and stored in the reception side memory function unit 34.

Note that, in the aforementioned updating step S33, the music information or difference in music information transmitted from the broadcasting apparatus 20 side constantly repeatedly or periodically on predetermined days is once held. When it is detected that the information is not the same as the already received information, the information is stored in the reception side memory function unit 34.

Referring to FIG. 2 and FIG. 3 again, FIG. 2 shows a track data request reception unit 27, a charge processing unit 28, and a schedule transmission unit 29, and FIG. 3 shows a track data request transmission unit 35.

In the present invention, not only the music database information, but also the track data are determined as the target for updating. However, from the viewpoint of copyrights etc., the distribution of the track data must be charged for. The above components 27, 28, 29, and 35 are introduced for this purpose.

In FIG. 2, the track data request reception unit 27 receives a request that the music information including the track data from the terminal 30 be stored together with the related terminal ID information. Also, the charge processing unit 28 charges the related terminal on the basis of the terminal ID information received by the track data request reception unit 27. Note that the track data request reception unit 27 may also output a track request as a selection condition to the selection function unit 22.

On the other hand, in FIG. 3, the track data request transmission unit 35 transmits a request input by the operation unit 9 that the music information including the track data be stored together with the related terminal ID information to the broadcasting side of the music information.

More preferably, provision is made of a schedule transmission unit 29. The transmission unit 29 transmits a schedule list indicating the schedule for transmitting the related track data to the related terminal.

The schedule list is required in this way because the size of the track data is especially large in comparison with the size of the music database and it is difficult to constantly constantly repeatedly transmit this. Accordingly, the schedule of distribution is determined for highly efficient transmission of track data.

Figure 4:
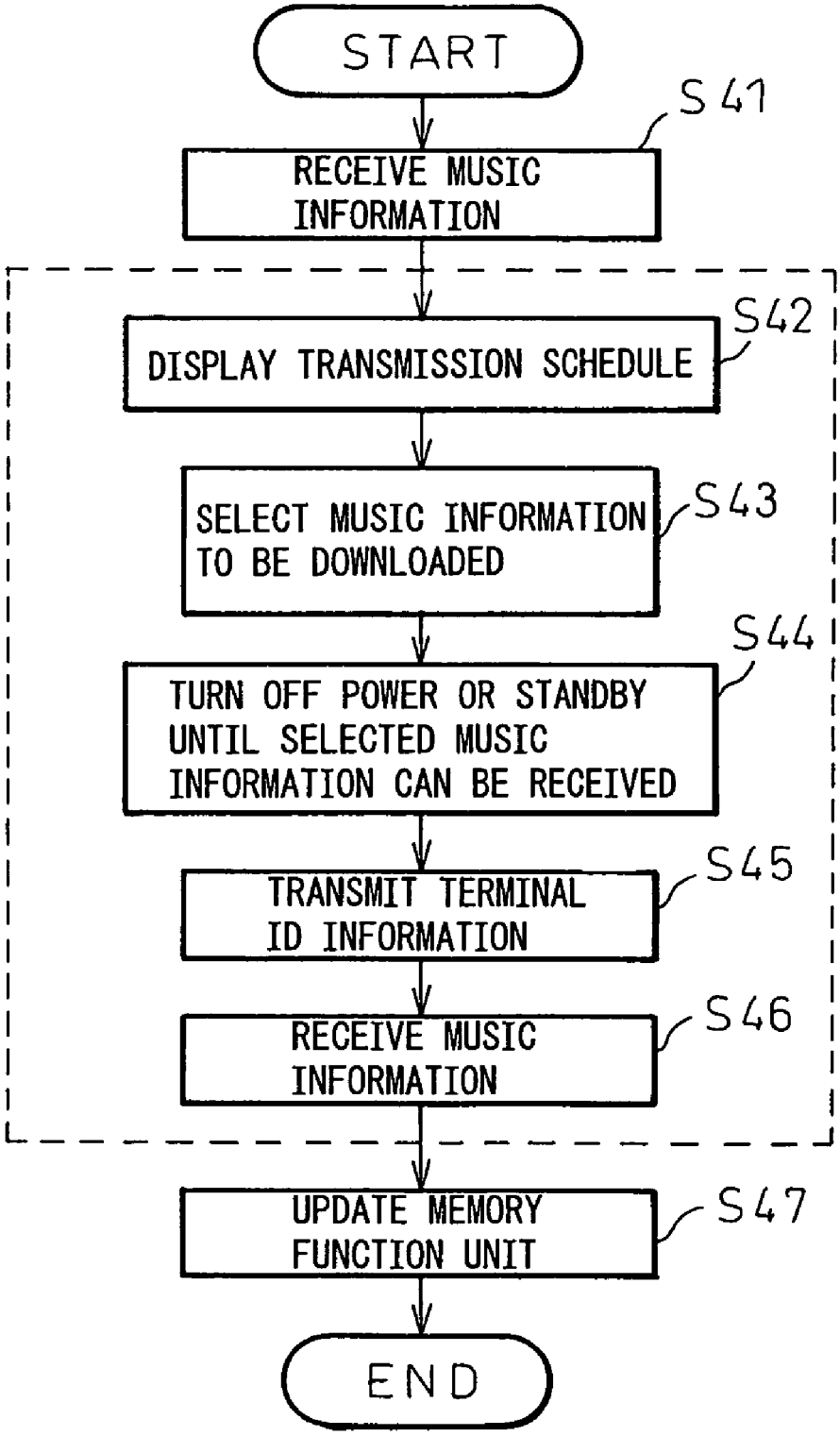
FIG. 4 is a flow chart showing an example of an operation of the terminal 30.

FIG. 4 is a flow chart showing an example of the operation of the terminal 30. Note that, in the figure, the steps surrounded by the broken line box are steps which become necessary when it is requested that the track data be stored and when the track data is stored.

In the figure, where it is requested to store the track data, and the track data is not stored (when the music menu information is received and updated etc.), Step S41: the music information is received, then Step S47: this is added to the memory function unit 34, whereby the updating is completed.

On the other hand, when it is requested to store the track data, and the track data is stored, after step S41, Step S42: the aforementioned schedule list, that is, the transmission schedule, is displayed on the display unit 2 (FIG. 3), and Step S43: the music information (track data) to be downloaded is selected from among them. This selection is carried out on the display unit 2 or in the operation unit 9.

Note that the operation unit 9 may be completely included in the GUI on the display unit 2 as well.

Step S44: After the selection, the receipt of the desired track data is awaited.

Step S45: Simultaneously, the aforementioned terminal ID information is transmitted from the track data request transmission unit 35 to the broadcasting apparatus 20 side. The transmission of this ID is carried out for the charge processing at the charge processing unit 28 as previously mentioned.

Step S46: The music information including the desired track data is received under the above schedule, then the routine reaches step S47, where the music information including the desired track data is added to the memory function unit 34 for the updating.

On the other hand, the operation of the broadcasting apparatus 20 corresponding to this is as follows.

Figure 5:
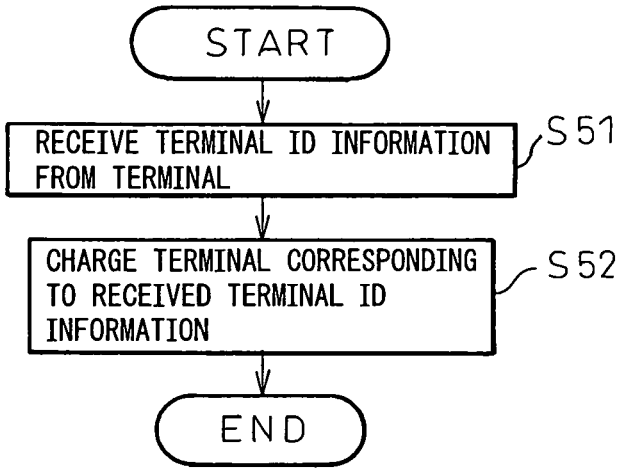
FIG. 5 is a flow chart showing an example of the operation (time of track data transmission) of the broadcasting apparatus 20.

FIG. 5 is a flow chart showing an example of the operation of the broadcasting apparatus 20 (at the time of the track data transmission).

In the figure,

Step S51: the terminal ID information based on step S45 of FIG. 4 is received at the track data request reception unit 27 (FIG. 2).

Step S52: The terminal ID information is forwarded to the charge processing unit 28 (FIG. 2), where the charge processing to the related terminal is carried out.

Note that, the broadcasting apparatus 20 operates as follows regardless of presence/absence of the transmission of the track data.

Figure 6:
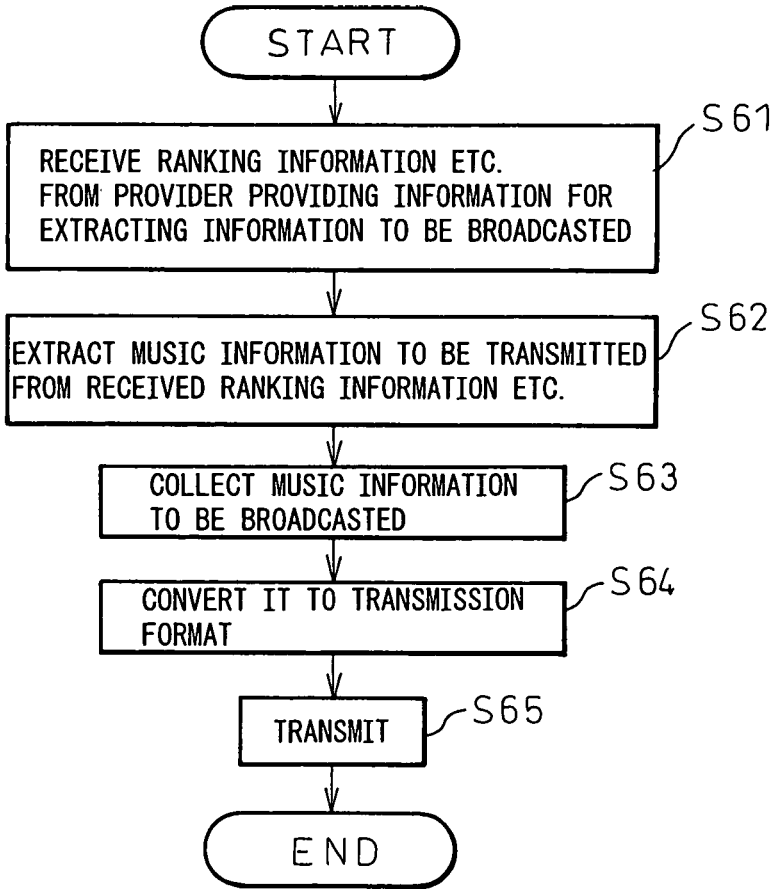
FIG. 6 is a flow chart showing an example of the operation of the broadcasting apparatus 20 at an ordinary time.

FIG. 6 is a flow chart showing an example of the operation of the broadcasting apparatus 20 at an ordinary time. Note, this example of operation represents the explanation of steps S11 and S12 mentioned above and steps concerned with this in the flow chart.

Step S61: In FIG. 2, the selection function unit 22 collects the information for selecting the recording media for updating from the music providers 25A, 25B, Step S62: The selection function unit 22 of FIG. 2 determines the music information for updating when the selection is completed.

Step S63: On the basis of the determination, the selection function unit 22 reads out the related music information from the database 24 of the memory function unit 21.

Step S64: In order to broadcast the read out music information on a predetermined broadcast channel, the music information is converted to a predetermined transmission format at the conversion function unit 26.

Step S65: Further, the transmission function unit 23 transmits the converted music information on the predetermined broadcast channel to the reception side (30).

The principal portions of the updating system 10 according to the present invention were individually explained above. Therefore, finally, an overall summary of the updating system 10 will be given. Note that, in order to receive the updating service of the present invention, a so-called key mechanism for maintaining secrecy naturally must exist between the broadcasting apparatus 20 including the public infrastructure such as broadcasting stations and individual terminals 30 of users receiving the service. A well known function unit such as a scrambler/descrambler may be introduced for this purpose.

Figure 7:
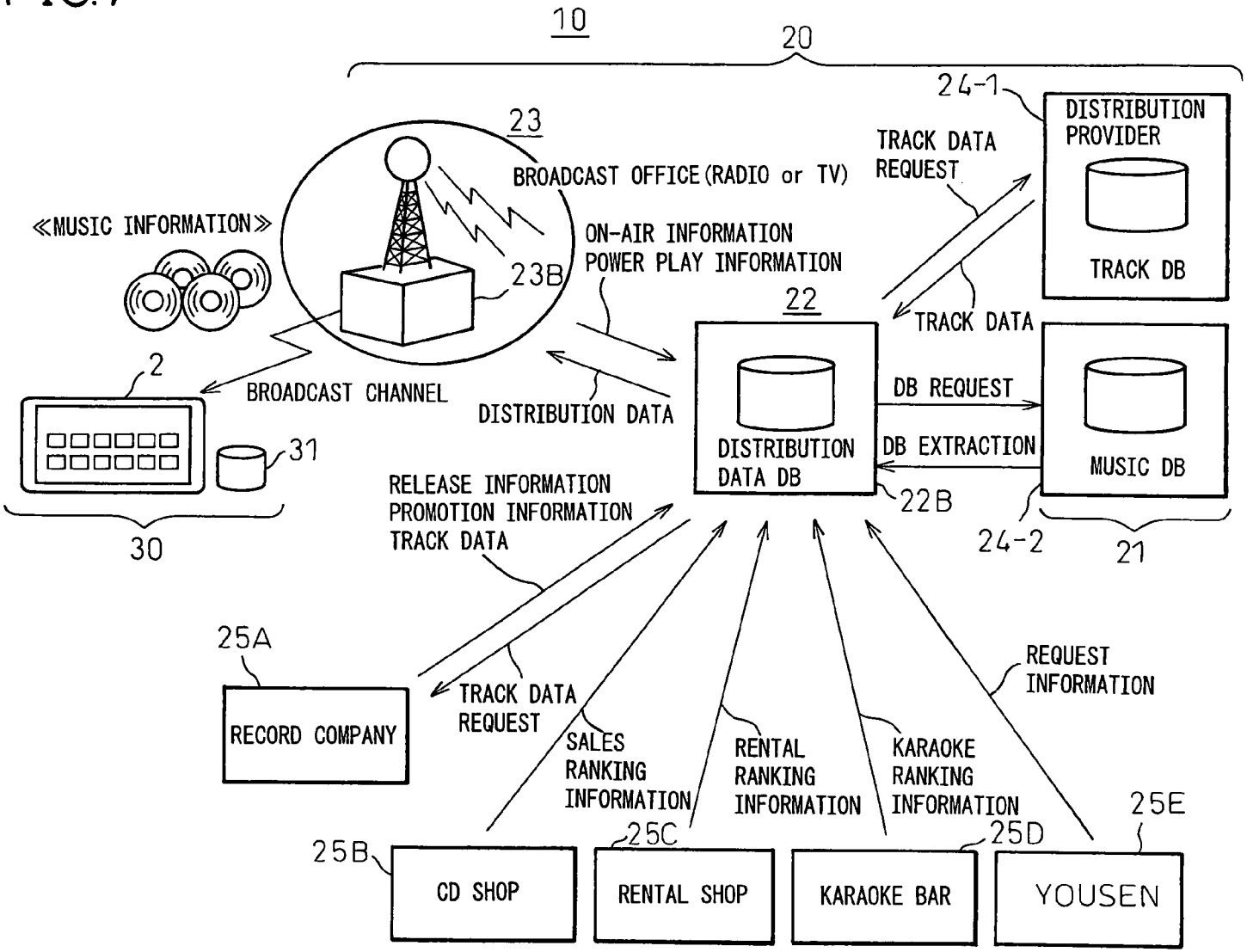
FIG. 7 is a diagram showing a more specific overall configuration of an updating system 10 according to the present invention.
Figure 8:
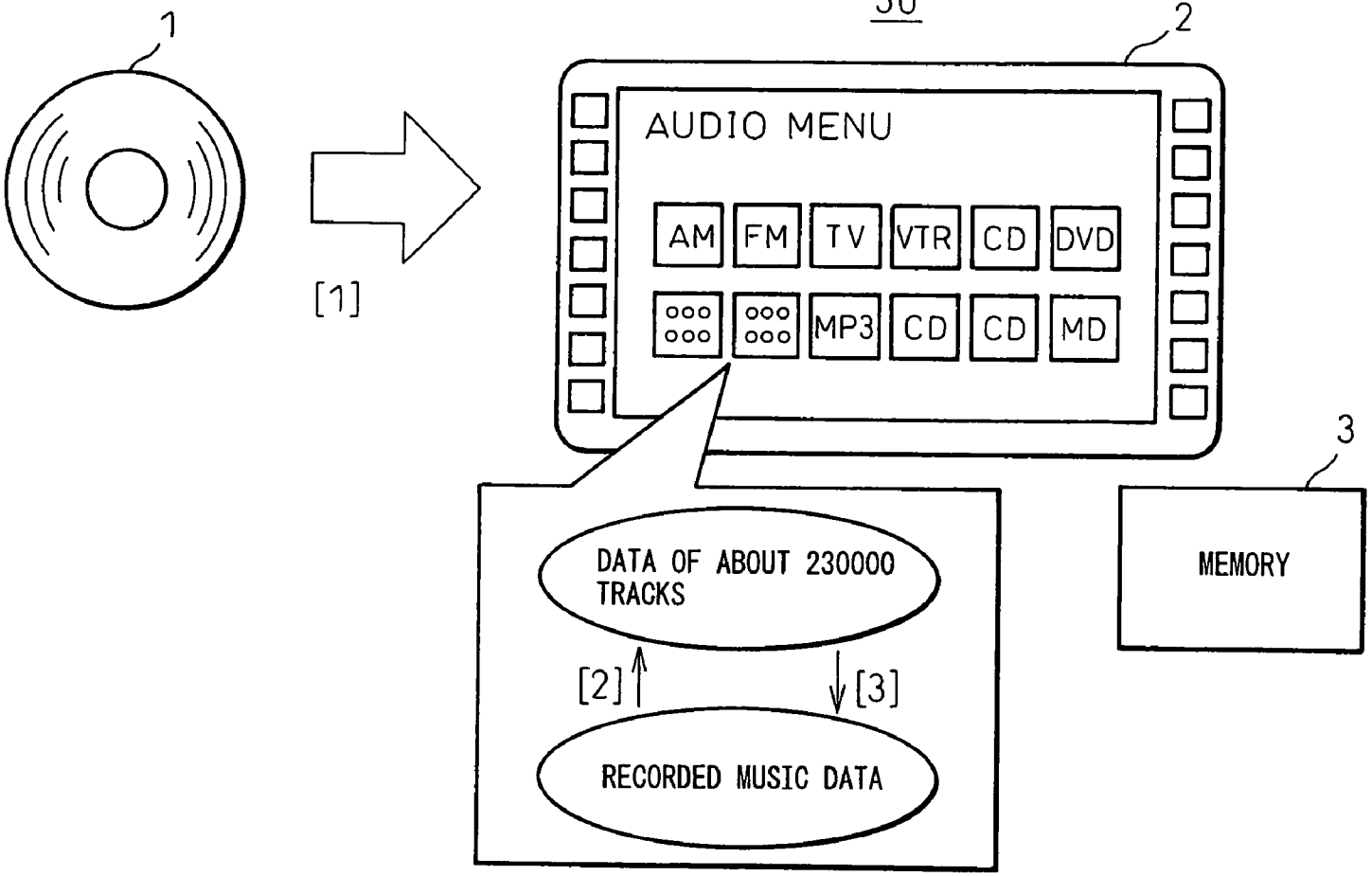
FIG. 8 is a diagram for explaining the music information covered by the present invention.
Figure 9:
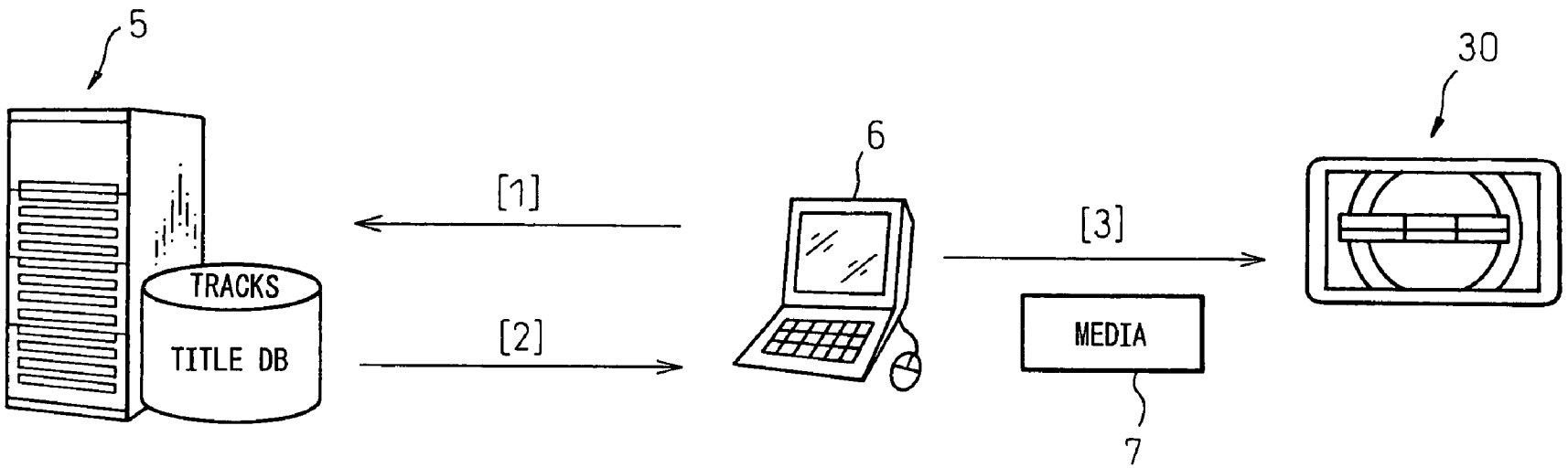
FIG. 9 is a diagram showing a conventional updating technique of music information (first example).

FIG. 7 is a diagram showing a further specific overall configuration of the updating system 10 according to the present invention.

In the figure, portions corresponding to portions in the already explained FIG. 2 and FIG. 3 are shown assigned the same reference numerals.

The updating system 10 is configured by a right side broadcasting apparatus 20, a left side terminal 30, and a radio path (broadcast channel) connecting these apparatuses.

The broadcasting apparatus 20 is configured by equipment and apparatus owned by the provider 21 in the figure. A provider 24-1 manages the aforementioned track database, a provider 24-2 manages the aforementioned broadcasting use music database, and a provider 23B manages the broadcasting equipment.

The provider 22B selects the music to be updated on the basis of on-air information, requests the corresponding music database information from the provider 24-2, extracts the music, and stores the same in its own database 22 DB. This is true also for the track database (tune DB) with respect to the provider 24-1. Further, the music information is forwarded to the provider 23B as the distribution data. Further, the provider 23B broadcasts the music information to the terminal 30 side while conveying it over the broadcast channel. The equipment 30 receives this and stores this in its own reception side memory function unit 31. The user can confirm the stored information at the display unit 2.

INDUSTRIAL APPLICABILITY

The present invention can be applied to the case of realizing a service for distributing favorite music information from an external music information source to a user side through a broadcast wave.

The invention claimed is:

1. An updating system of music information comprising:

a broadcasting apparatus having a broadcasting side memory unit for storing music information including at least one of track data and music database information and a transmission unit for broadcasting the music information on a predetermined broadcast channel and a terminal having a reception unit for receiving a broadcast wave of said predetermined broadcast channel, an extraction unit for extracting said music information from the received broadcast wave, and an update unit for updating the music information in a reception side memory unit with the extracted music information, said update unit once holds the music information or a newly added difference in music information transmitted from said broadcasting apparatus side constantly repeated or periodically on predetermined days and, when detecting that it is not the same as the already received information, stores the information in said reception side memory unit, and said update unit extracts the music information which is not recorded in the reception side memory unit from the received music database information as the difference in music information and stores the same in the reception side memory unit, wherein said predetermined broadcast channel is: either of a specific channel in radio broadcasts, a specific channel in TV broadcasts, or a specific channel in digital broadcasts and said music database information is comprised of identifying information for identifying the recording media and music menu information corresponding to the identifying information, and the music menu information includes at least one of title names, album names, artist names, and genres.

2. An updating system of music information as set forth in claim 1, wherein said terminal is further provided with a track data request transmission unit for transmitting a request that the music information including the desired track data be added to said reception side memory unit and the identifying information of the related terminal to said transmission apparatus, and said broadcasting apparatus is further provided with a charge processing unit for charging the related terminal on the basis of said track data request from said terminal and the identifying information of said terminal.

3. An updating system of music information as set forth in claim 1, wherein said broadcasting apparatus is further provided with a schedule transmission unit for broadcasting a schedule list indicating a schedule for broadcasting said track data.

4. An updating system of music information as set forth in claim 1, wherein said broadcasting apparatus is provided with a selection unit for selecting said music information to be transmitted from said broadcasting side memory unit or selecting said music information to be stored in said broadcasting side memory unit.

5. An updating system of music information as set forth in claim 4, wherein said selection unit selects said music information on the basis of at least any of various popularity ranking information, number of times of broadcasts, new music releases, and power play information provided from music providers.

6. An updating system of music information as set forth in claim 4, wherein said selection unit selects said music information on the basis of a request that the music information including the desired track data from said terminal be added to said reception memory unit.

7. An updating system of music information as set forth in claim 1, wherein said transmission unit broadcasts said music information on said predetermined broadcast channel constantly repeatedly or periodically on predetermined days.

8. An updating system of music information as set forth in claim 4, wherein said selection transmits either of all said music information of said broadcasting side memory unit or a difference in music information newly added to said broadcasting side memory unit to said transmission unit.

9. An updating system of music information as set forth in claim 8, wherein said update unit rewrites said reception side memory unit with received music information when receiving all music information of said broadcasting side memory unit.

10. An updating system of music information as set forth in claim 8, wherein said updating unit stores the difference in music information added to said reception side memory unit newest when receiving the difference in music information added newest to said broadcasting side memory unit.

11. A terminal having an updating function of music information, comprising:

a reception side memory unit for storing music information including at least one of track data and music database information;

an extraction unit for extracting said music information from the broadcast wave of a predetermined broadcast channel transmitted from a broadcasting apparatus; and an update unit for updating the music information in said reception side memory unit with said extracted music information, said update unit once holds the music information or a newly added difference in the music information transmitted from said broadcasting apparatus side constantly repeatedly or periodically on predetermined days and, when detecting that is not the same as the already received information, stores the information in said reception side memory unit, and said update unit extracts the music information which is not recorded in the reception side memory unit from the received music database information as the difference in music information and stores the same in the reception side memory unit, wherein said predetermined broadcast channel is: either of a specific channel in radio broadcasts, a specific channel in TV broadcasts, or a specific channel in digital broadcasts and said music database information is comprised of identifying information for identifying the recording media and music menu information corresponding to the identifying information, and the music menu information includes at least one of title names, album names, artist names, and genres.

12. An updating method of music information in an updating system of music information provided with a broadcasting apparatus and a terminal comprising:

in said broadcasting apparatus, a step of broadcasting music information including at least one of track data and music database information stored in a broadcasting side memory unit on a predetermined broadcast channel and, in said terminal provided with a reception side memory unit for storing said music information, a step of receiving the broadcast wave of said predetermined broadcast channel, a step of extracting said music information from the broadcast wave of said received predetermined broadcast channel, and a step of updating, by an update unit, the information in said reception side memory unit with said extracted music information, said update unit once holds the music information or a newly added difference in the music information transmitted from said broadcasting apparatus side constantly repeatedly or periodically on predetermined days and, when detecting that is not the same as the already received information, stores the information in said reception side memory unit, and said update unit extracts the music information which is not recorded in the reception side memory unit from the received music database information as the difference in music information and stores the same in the reception side memory unit, wherein said predetermined broadcast channel is: either of a specific channel in radio broadcasts, a specific channel in TV broadcasts, or a specific channel in digital broadcasts and said music database information is comprised of identifying information for identifying the recording media and music menu information corresponding to the identifying information, and the music menu information includes at least one of title names, album names, artist names, and genres.

13. A music information updating method of music information in a terminal provided with a reception side memory unit for storing the music information including at least one of track data and music database information from a broadcasting apparatus, comprising:

a step of receiving said music information broadcasting on a predetermined broadcast channel;

a step of extracting said music information from said received predetermined broadcast channel; and a step of updating the music information in said reception side memory unit with said extracted music information, said update unit once holds the music information or a newly added difference in the music information transmitted from said broadcasting apparatus side constantly repeatedly or periodically on predetermined days and, when detecting that is not the same as the already received information, stores the information in said reception side memory unit, and said update unit extracts the music information which is not recorded in the reception side memory unit from the received music database information as the difference in music information and stores the same in the reception side memory unit, wherein said predetermined broadcast channel is: either of a specific channel in radio broadcasts, a specific channel in TV broadcasts, or a specific channel in digital broadcasts and said music database information is comprised of identifying information for identifying the recording media and music menu information corresponding to the identifying information, and the music menu information includes at least one of title names, album names, artist names, and genres.

* * * * *